United States Patent [19]

Pitt

[11] Patent Number: 4,881,354

[45] Date of Patent: Nov. 21, 1989

[54] SECURITY GRILLE AND MANUFACTURING METHOD

[76] Inventor: Alan D. Pitt, Tree Tops, 19 Forest Close, Bewdley, DY12 2UF, England

[21] Appl. No.: 202,197

[22] Filed: Jun. 3, 1988

[30] Foreign Application Priority Data

Jun. 26, 1987 [GB] United Kingdom ..... 8715037
Mar. 2, 1988 [GB] United Kingdom ..... 8804977

[51] Int. Cl.[4] ..... E04C 2/38; E04C 2/42

[52] U.S. Cl. ..... 52/665; 52/507; 403/174; 403/218; 49/50

[58] Field of Search ..... 52/665, 507, 82, 106, 52/648; 403/174, 178, 218; 411/2, 3, 5; 49/50–57

[56] References Cited

U.S. PATENT DOCUMENTS

| | | | |
|---|---|---|---|
| 1,147,100 | 7/1915 | Rietzel | 52/665 |
| 1,240,025 | 9/1917 | Carson | 49/55 |
| 2,018,539 | 10/1935 | Welsh | 403/218 |
| 3,323,820 | 6/1967 | Braccini | 403/218 |
| 3,512,447 | 5/1970 | Vaughn | 411/5 |
| 4,037,515 | 7/1977 | Kesselman | 411/3 |
| 4,038,800 | 8/1977 | Daley, Jr. | 49/55 X |
| 4,432,162 | 2/1984 | Foote | 49/55 |
| 4,615,142 | 10/1986 | Reeves | 49/55 |
| 4,723,388 | 2/1988 | Zieg | 403/174 |

FOREIGN PATENT DOCUMENTS

| | | | |
|---|---|---|---|
| 82970 | 2/1921 | Austria | 49/57 |
| 2077344 | 12/1981 | United Kingdom | 49/56 |
| 2123109 | 1/1984 | United Kingdom | 403/174 |

*Primary Examiner*—David A. Scherbel
*Assistant Examiner*—Anthony W. Williams
*Attorney, Agent, or Firm*—Albert L. Jeffers; David L. Ahlersmeyer

[57] ABSTRACT

A security grille is disclosed in which corresponding ends of rods, preferably of square cross-sectional shape, are clamped by initially-separate halves of clamps. The halves of each clamp become connected permanently to one another by a nut/bolt combination, wherein the nut has a drive head which shears off when the connection has been properly made. In one embodiment, the clamp halves are made by drop-stamping and the rods are made from hot-rolled steel bars. Alternatively, the clamp halves may be made as pressings and the rods may be made from cold-drawn steel bars. The clamp halves are provided with decorative covers.

12 Claims, 4 Drawing Sheets

Fig. 1
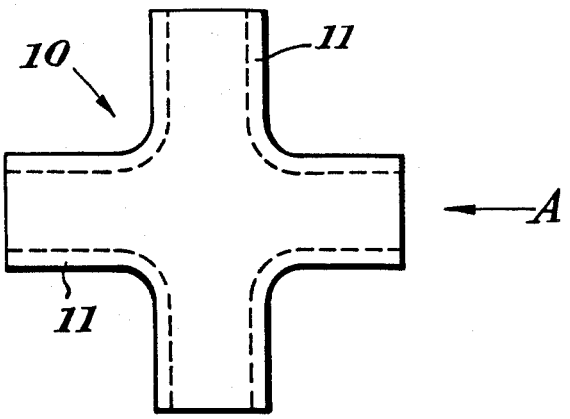
Fig. 2
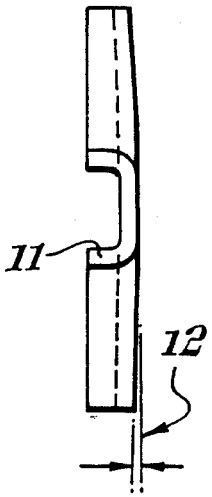
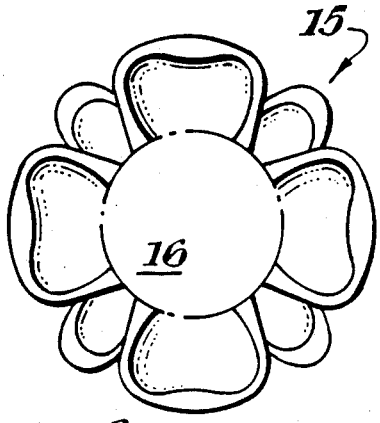
Fig. 3
B
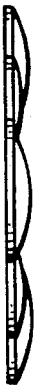
Fig. 4
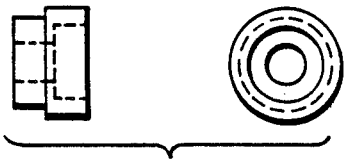
Fig. 5

SECURITY GRILLE AND MANUFACTURING METHOD

This invention relates to a security grille and to a manufacturing method.

People who live in houses or apartments (either as owners or as people who pay rents) would like to protect their homes against intrusion by criminals, vandals or "squatters"; one way in which security can be considerably improved is by covering windows, and even doors, by security grilles. A security grille is a lattice, grating or screen which is usually made of metal parts welded to one another and which is securely mounted in an appropriate manner on the brickwork, masonry or concrete of the building. The cost of having such security grilles provided and fitted by a specialist company or even the cost of employing a firm of builders to buy and then install such security grilles is, however, beyond the income of most people and there is a demand for a "do-it-yourself" product.

From a first aspect, therefore, the present invention consists a security grille adapted for fixing to a structure so as to extend across an aperture therein, said grille including at least one pair of rods whose corresponding one ends are fixed to said structure and whose corresponding other ends are connected to one another by two initially separate portions of a device which are so permanently joined to one another as to clamp said other ends between them.

In one embodiment of the security grille described in the preceding paragraph, there may be two pairs of rods with one pair arranged on a first straight line which is normal to a second straight line on which the other pair is arranged, the corresponding one ends of the four rods being fixed to said structure and the corresponding, other ends of the four rods being connected to one another by the portions of said device.

In another embodiment of the security grille described in the second preceding paragraph, there may be a plurality of rods and a plurality of devices each of which comprises two initially separate portions which have been permanently joined to one another, all of said rods having a first end thereof clamped between the two portions of a respective one of said devices, some of said rods having the second end thereof clamped between the two portions of a respective other of said devices, and some of said rods having the second end thereof fixed to said structure.

Preferably, the rods are of square cross-sectional shape.

In the security grille as described in any one of the four preceding paragraphs, each of said devices may have its two initially separate portions permanently joined to one another by means of a nut and bolt, the head of the bolt having its axially outer surface flush with that of one of the portions, and the axially outer surface of the nut being flush with that of the other of the portions as a result of an hexagonal drive head of said nut having sheared off when the critical torsional load has been applied to said head.

In the security grille as described in any one of the five preceding paragraphs, said initially separate portions of each device are preferably identical with one another, each portion being bored and counterbored centrally and also being provided with recesses which are formed in one face of the portion and which radiate from the centre of the portion. It will be preferred for there to be four equi-spaced recesses in said one face of each portion.

It is well-known that any article made by drop-stamping (also called drop-forging) cannot be made to close tolerances and it is also well-known that bars made by the hot-rolling method also cannot be made to close tolerances. Thus, with a clamp which comprises two clamp-halves and four square-section bars whose end portions are to be clamped by said clamp, there are six components all of whose dimensions may not be in accordance with their ideal specification and this fact can lead to a poor or relatively poor standard of clamping or at least to an unpredictable standard of clamping. Such an eventuality could be regarded as unacceptable in security grilles, which are intended to be of the highest quality and therefore of the highest rating in the eyes of an insurance company.

Moreover, it may be desirable (from the point of view of the ultimate consumer) to make the resultant security grille as visually attractive as possible.

According to a second aspect, therefore, the present invention consists in a method of manufacture of a clamp for use in making a security grille, said method comprising the following steps, namely, (1) forming two half-clamps separately as pressing;

(2) forming an aperture in each of said two half-clamps; and (3) in the case of each of said two half-clamps, forcing a case-hardened bush insert, which is so made as to be an interference fit in said aperture, by means of a press into said aperture.

In a method as described in the preceding paragraph, there may be the following additional steps, namely, (1) forming two decorative covers, as pressings, one for each of said half-clamps;

(2) forming an aperture in each of said two decorative covers; and (3) connecting a respective one of said covers to a respective one of said half-clamps by firstly placing the cover on the half-clamp in such a way that the respective apertures therein are in precise axial alignment with one another and secondly forcing a case-hardened bush insert, which is so made as to be an interference fit in said apertures, by means of a press into said aligned apertures.

According to a third aspect, the present invention consists in a method of manufacture of a clamp for use in making a security grille, said method comprising the following steps, namely, (1) forming two half-clamps separately as pressings; and (2) mounting case-hardened bush inserts in said two half-clamps by using, in the case of each half-clamp, a press to cause a respective one of the inserts to act as a punch in order to make a hole in said half-clamp in which hole said insert will be a very tight fit.

In a method as described in the preceding paragraph, a respective one of said half-clamps and a decorative cover therefor may be placed in said press, one on top of the other, and thereafter said press may be used to cause said respective one of the case-hardened bush inserts to act as a punch in order to make aligned holes in said half-clamp and said cover, whereby said insert will be a very tight fit in said aligned holes and will secure the cover and the half-clamp to one another.

According to a fourth aspect, the present invention consists in a security grille which comprises an assembly of one or more clamps and a number of bars, at least some of the ends of said bars being clamped by the clamp(s) and some of the bars having ends which are adapted to facilitate the fixing of the security grille to a building; each clamp comprising two half-clamps and each half-clamp having a number of channel-shaped limbs; said limbs being connected to one another to form a central portion of the half-clamp; the central portion being apertured in order to accept a fixing screw or bolt; that part of each channel which forms the bottom thereof lying, in said central portion of the half-clamp, on a plane; the free end portions of the channel-shaped limbs being canted away from said plane in the direction in which the walls of the respective channel are directed; whereby two such half-clamps, so placed on the ends of bars that said ends are enclosed by the channels formed by the facing channel-shaped limbs and securely connected to one another by screw means or nut-and-bolt means, exert a clamping action on said bar ends as a result of the canted free end portions of the channel-shaped limbs of each half-clamp being forced against the bar end in such a way as to be flexed towards the plane of the central portion of the respective half-clamp.

In one advantageous embodiment of the security grille described in the preceding paragraph, each free end portion of each channel-shaped limb is canted at an angle of about 4° to 5° away from the plane on which the central portion of the half-clamp lies.

In a security grille as described in either of the preceding paragraphs, the bars will preferably be made of cold-drawn steel (so-called bright bar) and the half-clamps will preferably be made as pressings.

In a security grille as described in the preceding paragraph, the half-clamps will preferably be made either according to the second aspect of the present invention or according to the third aspect thereof.

Some embodiments of methods of manufacture according to the second and third aspects of the present invention, and some embodiments of a security grille according to the first and fourth aspects thereof, will now be described with reference to the accompanying diagrammatic drawings, it being understood that all embodiments so described and so illustrated are given by way of example only. In said drawings:

FIG. 1 represents a plan view of a half-clamp pressing;

FIG. 2 represents a view of one side of the half-clamp pressing, looking in the direction indicated by the arrow A in FIG. 1;

FIG. 3 represents a plan view of a so-called decorative cover formed as a pressing;

FIG. 4 is a side view of said decorative cover, looking in the direction indicated by the arrow B in FIG. 3;

FIG. 5 illustrates two views of a bush insert;

Figure 6:
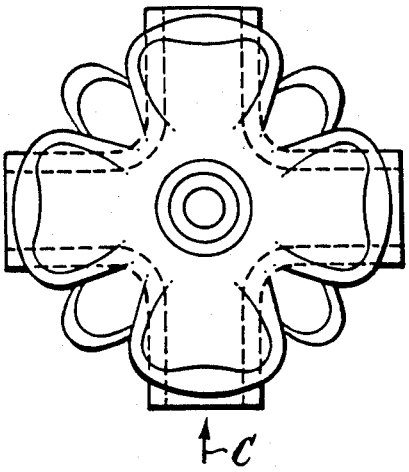
FIG. 6 is a plan view of a half-clamp which has been connected to a decorative cover by means of a bush insert to form an unitary structure.
Figure 7:
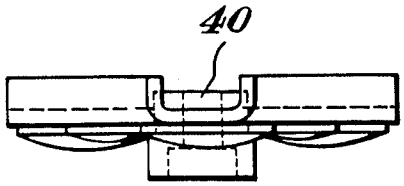
FIG. 7 is a side view of the assembly illustrated in FIG. 6, looking in the direction indicated by the arrow C in FIG. 6.
Figure 8:
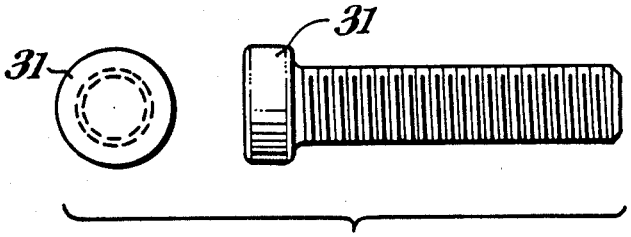
Figure 9:
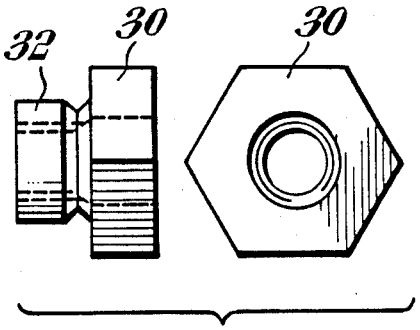
Figure 10:
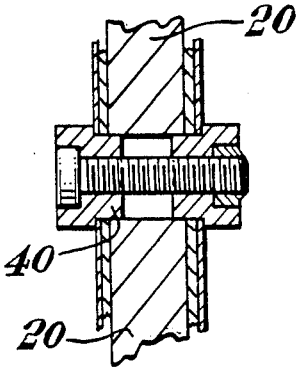

FIG. 8 illustrates two views of a bolt (screw) and FIG. 9 illustrates two views of a shear nut, said bolt and said nut being intended for the securing to one another of a pair of the unitary structures, shown in FIGS. 6 and 7, for the purpose of clamping the respective ends of four separate bars; and FIG. 10 represents, partially in section, the respective ends of two bars which have been securely connected to one another by two of said unitary structures which have been securely connected to one another by a bolt and shear nut as just described.

Figure 11:
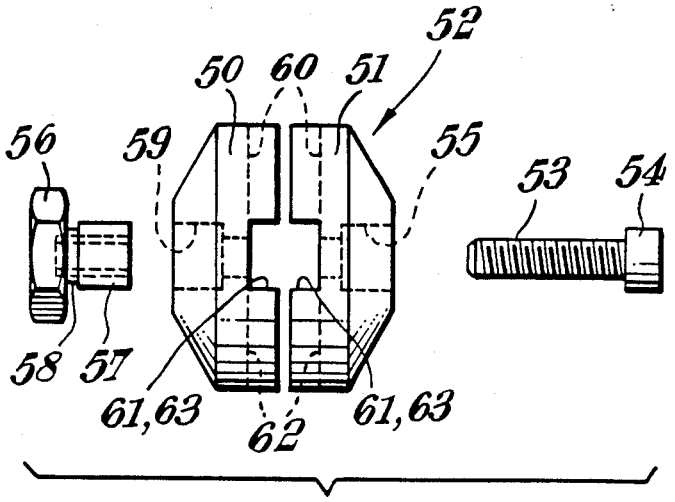
Figure 12:
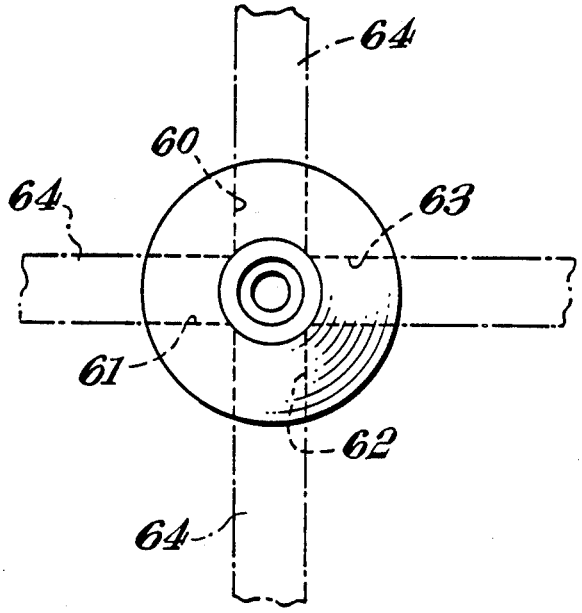
Figure 13:
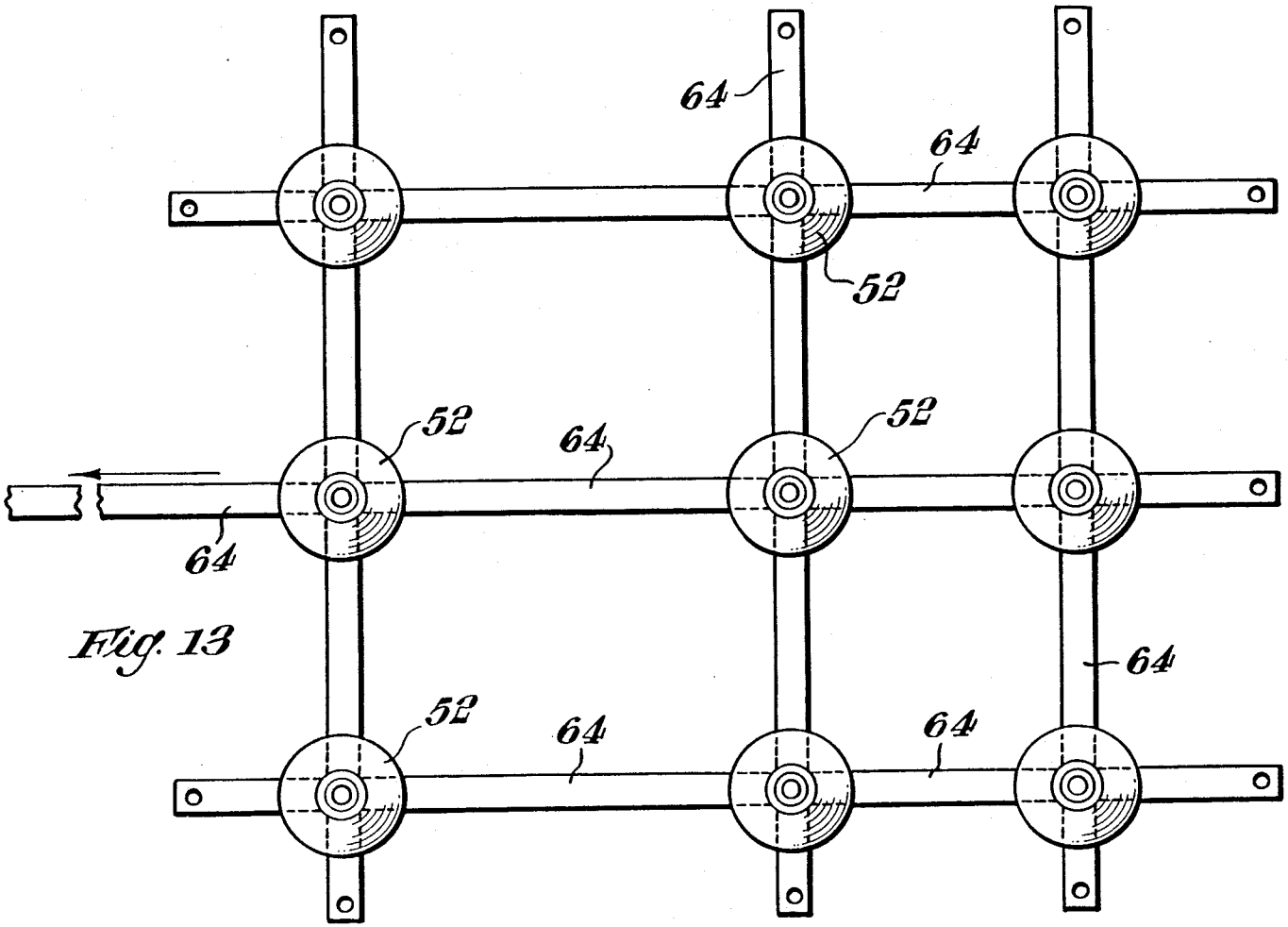

FIG. 11 shows another embodiment of a clamping device for use in making a security grille according to the invention;

FIG. 12 shows the manner in which square rods can be connected to one another by said clamping device of FIG. 11; and FIG. 13 shows one particular layout of grille which can be made up with such clamping devices and square rods.

Referring firstly to FIGS. 11 and 12, it will be apparent that, having appropriately aligned two initially separate portions 50, 51 of a clamping device 52, each of which portions is bored and counter-bored, a bolt 53 can be inserted so as to extend through the aligned bores in order to bring the head 54 thereof into a cavity 55 which is of complementary shape and depth. Thereafter, a special nut, which consists of a hexagonal head 56 and an internally screw-threaded annulus 57 connected to one another by a neck 58, is caused to engage the free end of the bolt 53 and is tightened up until such time as the neck 58 shears off. In that state, the annulus 57 will have become accommodated in a recess 59 whose shape and depth are complementary to those of the annulus 57. In view of the fact that the axially outer surface of the head 54 of the bolt and the axially outer surface of the annulus 57 are flush with the axially outer surfaces of the respective portions 51, 50, it will be virtually impossible for any person thereafter to separate said portions; once joined to one another in the manner described above, it will be virtually impossible to undo the portions without cutting equipment of some kind.

Each of said portions is provided in one face thereof with recesses 60, 61, 62, 63 which are of such a depth as to result in the ends of square rods 64, placed in said recesses and between the appropriately aligned portions, being very firmly clamped between the portions 50, 51 after these have been connected to one another by the bolt 53 and annulus 57 in the manner already described.

Turning to FIG. 13, it will be readily appreciated that it will be an easy matter to create a grille of virtually any size to suit the aperture in the particular structure (namely, a window or doorway in a building). If the window were to be extremely small (e.g. a larder window in a house) or if it were considered to be necessary, for example, to cover an air outlet or inlet in a wall of some industrial or commerical building, a grille could be made using only two rods and one two-portion device 52. The rods would be placed in a straight line and would have their corresponding ends placed in aligned recesses 60, 62 (see FIG. 12) and thereafter the portions 50, 51 would be permanently connected to one another by a nut and bolt as described above. The corresponding other ends of each of the rods would need to be provided with some means of enabling them to be secured to the structure, as for example by screws or by more sophisticated fixing means.

A slightly larger aperture in a building could be covered by a grille which would consist of four rods 64 whose corresponding one ends are clamped between the portions of a device 52 and whose corresponding other ends are fixed to the structure.

In larger grilles, it will be seen from FIG. 3 that all of the rods 6 have one end clamped between the portions of a clamping device 52, some of the rods have their other ends secured to the structure and some of the rods have their other ends clamped between the portions of another device 52.

One very convenient manner in which the security grille according to the present invention may be marketed is that of a kit of parts, the kits being of different contents in dependence upon the size of the required grille and including the means for enabling the various rods to be secured to the structure. Moreover, the rods 64 (which need not all be of the same length) and the devices 52 can be sold individually.

It is to be understood that, although the axial lengths of the head 54 of the bolt and of the annulus 57 are stated to be equal to the depths of the cavity 55 and of the recess 59 respectively, such an arrangement is not essential. Indeed, in order to achieve manufacturing economies, it may be desirable to reduce the axial lengths of said head 54 and of the annulus 57; such reduction would mean that the axially outer surfaces thereof would be below the level of the axially outer surfaces of the portions 50, 51 and this might even prove to be an advantage.

It is also to be understood that only the radially inner surface of the annulus 57 need be screw-threaded (as shown in FIG. 11, the neck 58 is also screw-threaded internally). If the tapping of the thread is carried out only upon the annulus 57, such arrangement will actually tend to promote the shearing taking place at the junction between the annulus 57 and said neck. On the other hand, if both the annulus 57 and the neck 58 are internally threaded, shearing will take place at the junction between said neck and the hexagonal head 56.

FIG. 12 illustrates a portion 50 or 51 which has four recesses which are arranged so as to be separated by 90° from one another around the centre of said portion. This is not to be taken as a limitation; in fact, a decorative design of grille can be made, employing the idea underlying the present invention, by providing each portion 50, 51 with three recesses which are spaced from one another by 120°.

Referring now to the other drawings, which are virtually self-explanatory, it will be seen that a half-clamp (FIGS. 1 and 2) is formed as a pressing in order to provide a cruciform element 10 each of whose limbs 11 is channel-shaped in section; the four limbs 11 can be regarded as being joined to one another in order to form a central portion or web of the element 10. Said central portion of the element 10 may be apertured in a separate step after the pressing operation. The decorative cover 15 (FIGS. 3 and 4) is also formed as a pressing and has a central web 16 which may be apertured in a separate step after the pressing operation. In order to secure the element 10 to the cover 15, the two are placed one on top of the other and the apertures therein are brought into exact register with one another; thereafter, a bush insert (FIG. 5) is forced as an interference fit into the aligned apertures in a press, the resultant assembly or unitary structure being shown in FIGS. 6 and 7. In an alternative mode of operation, the unapertured webs of the element 10 and decorative cover 15 may be placed in contact with and in exact register with one another and, thereafter, a press can be used to drive a bush insert (which is, of course, case-hardened) into the superimposed element/cover, the leading end of the insert acting as a punch and punching holes in said central webs, and the insert becomes, of course, fixed in said holes and acts as the means by which the element 10 and the cover 15 are connected to one another.

In order to form a security grille from bars 20 (FIG. 10), the respective ends of said bars are placed in the channels of respective limbs 11 of the element 10 and another element is placed on the exposed surfaces of said respective ends, the result being that each of said ends is loosely sandwiched between two facing elements. The secure connection of said respective ends of the bars 20 to one another is then effected by causing a bolt (which is shown in FIG. 8 and whose enlarged head is devoid of any diametral slot which could be engaged by a screwdriver and is devoid of any other similar engaging means) to extend through the aligned bush inserts, a nut (FIG. 9) is engaged with the threaded end of the bolt and is tightened up until the hexagonal drive head 30 of the nut shears off. In that condition, neither the head 31 of the bolt nor the annular portion 32 can easily be reached by any kind of tool and therefore the connection is to all intents and purposes completely tamper-proof.

Referring to FIG. 2, it will be seen that quite a large central portion of the element 10 is flat and that the remaining free end portions of the limbs 11 are canted at an included angle of about 4°–5°; the flat area may be regarded as lying on the plane 12 (FIG. 2) and the angle is measured by reference to said plane. This canting of the free end portions of the limbs 11 of the element 10 is for the purpose of causing those free end portions of any two facing elements 10 to grip or clamp the ends of the respective bars 20; this gripping or clamping effect will result from the fact that said canted limbs will tend to be straightened out or flexed towards said plane 12 as the bolts/nuts are tightened up.

The rods or bars 20 are made of cold-drawn steel) so-called bright metal) which is made to closer tolerances than hot-rolled steel which is sometimes called black metal or non-bright metal. The closer tolerances are needed because the more ends of bars which need to be interconnected by pairs of half-clamps, the greater is the difficulty of ensuring the proper degree of clamping of those ends. Thus, obtaining reasonably close tolerances by the use of pressings for the elements 10 and for the decorative covers 15, the use of bright metal bars and also the provision of the canting described in the preceding paragraph are the measures which are intended, together, to ensure proper clamping.

The use of pressings for the element 10 and the cover 15 as distinct from making those components by drop-stamping, together with the use of the so-called bright metal, as resulted in the end-product being cheaper. This is of particular importance when the "do-it-yourself" market is being aimed at, with the various essential components being sold either in kit form or loose.

Of course, the half-clamps do not have to be cruciform and each half-clamp could have another shape, for example, with three equally spaced legs. Moreover, the decorative covers (FIGS. 3 and 4) are obviously not essential, particularly for some applications but they will be desirable, it is thought, for the domestic consumer.

Lastly, referring to FIG. 7, it will be seen that there is a portion 40 of the bush insert which will act as an end-stop for positioning rods or bars correctly in the respective channels. Without such a positive, centrally located end-stop 40, it would be possible for two longitudinally-aligned bars (namely, bars placed in opposed channels) to be in end-to-end contact with one another but with too small a portion of one of those bars being clamped. The existence of the end-stop 40 will ensure that the assembler of the grille will place the proper length of all ends of the various bars in the respective channels before the clamp is tightened up.

The mention of about 4°–5° as the angle of cant of the free portions of the limbs 11 is not to be taken as inferring that said range is critical.

I claim:

1. A security grille adapted for fixing to a structure so as to extend across an aperture therein, said grille including at least one pair of rods whose corresponding one ends are adapted to be fixed to said structure and whose corresponding other ends are adapted to be connected to one another by two initially separate portions of a device which are subsequently so permanently joined to one another as to clamp said other ends between them, each of said two separate portions including a central portion and a plurality of channel-shaped limbs extending radially outwardly from said central portion, each limb having a proximal end attached to said central portion and a free distal end, said other ends of said pair of rods being placed between an associated pair of inwardly facing channel-shaped limbs comprising one limb from each of said two separate portions, the respective free distal ends of said associated pair of limbs being canted toward one another with respect to said respective central portions, whereby the respective free distal ends exert a clamping force on the rod ends when the two separate portions of the device are joined together.

2. A grille as claimed in claim 1, and comprising two pairs of rods with one pair arranged on a first straight line which is normal to a second straight line on which the other pair is arranged, the corresponding one ends of the four rods being fixed to said structure and the corresponding other ends of the four rods being connected to one another by the portions of said device.

3. A grille as claimed in claim 2, wherein said initially separate portions of each device are identical with one another, each portion being bored and counterbored centrally and also being provided with recesses which are formed in one face of the portion and which radiate from the centre of the portion and which are for the accommodation of said other ends.

4. A grille as claimed in claim 1, and comprising a plurality of rods and a plurality of devices, each of which devices comprises two initially separate portions which have been permanently joined to one another, all of said rods having a first end thereof clamped between the two portions of a respective one of said devices, some of said rods having the second end thereof clamped between the two portions of a respective other of said devices, and some of said rods having the second end thereof fixed to said structure.

5. A grille as claimed in claim 4, wherein the rods are of square cross-sectional shape.

6. A grille as claimed in claim 1, wherein each of said devices has its two initially separate portions permanently joined to one another by means of a nut and bolt, the head of the bolt having its axially outer surface flush with that of one of the portions, and the axially outer surface of the nut being flush with that of the other of the portions as a result of an hexagonal drive head of said nut having sheared off when the critical torsional load has been applied to said drive head.

7. A grille as claimed in claim 1, wherein said device has a cruciform shape.

8. A security grille which comprises an assembly of one or more clamps and a number of bars, at least some of the ends of said bars being clamped by the clamp(s) and some of the bars having ends which are adapted to facilitate the fixing of the security grille to a building; each clamp comprising two half-clamps and each half-clamp having a number of channel-shaped limbs; said limbs being connected to one another to form a central portion of the half-clamp; the central poriton being apertured in order to accept a fixing screw or bolt; that part of each channel which forms the bottom thereof lying, in said central portion of the half-clamp, on a plane; the free end portions of the channel-shaped limbs being canted away from said plane in the direction in which the walls of the respective channel are directed; whereby two such half-clamps, so placed on the ends of bars that said ends are enclosed by the channels formed by the facing channel-shaped limbs and securely connected to one another by nut-and-bolt means, exert a clamping action on said bar ends as a result of the canted free end portions of the channel-shaped limbs of each half-clamp being forced against the bar end in such a way as to be flexed towards the plane of the central portion of the respective half-clamp.

9. A security grille as claimed in claim 8, wherein each free end portion of each channel-shaped limb is canted at an angle of about 4°–5° away from the plane on which the central portion of the half-clamp lies.

10. A security grille as claimed in claim 8, wherein the bars are made of cold-drawn steel and the half-clamps are made as pressings.

11. A security grille as claimed in claim 8, wherein said nut and bolt means comprises a bolt having its axially outer surface flush with that of one of the portions, and the axially outer surface of the nut being flush with that of the other of the portions as a result of a hexagonal drive head of said nut having sheared off when the critical torsional load has been applied to said drive head.

12. A security grille as claimed in claim 8, wherein said half-clamps have a cruciform shape.

* * * * *